US008181710B2

(12) United States Patent
Tsuji et al.

(10) Patent No.: US 8,181,710 B2
(45) Date of Patent: May 22, 2012

(54) TUBE-END DEVICE FOR FIRE EXTINGUISHMENT

(75) Inventors: Toshihide Tsuji, Tokyo (JP); Tatsuya Hayashi, Tokyo (JP)

(73) Assignee: Hochiki Corporation, Tokyo (JP)

( * ) Notice: Subject to any disclaimer, the term of this patent is extended or adjusted under 35 U.S.C. 154(b) by 226 days.

(21) Appl. No.: 12/768,119

(22) Filed: Apr. 27, 2010

(65) Prior Publication Data

US 2010/0213291 A1 Aug. 26, 2010

Related U.S. Application Data

(63) Continuation of application No. PCT/JP2009/050655, filed on Jan. 19, 2009.

(51) Int. Cl.
*A62C 35/58* (2006.01)

(52) U.S. Cl. ..... 169/85; 239/690.1

(58) Field of Classification Search ..... 239/690, 239/690.1, 693, 706, 707; 169/30, 71, 89, 169/68, 85

See application file for complete search history.

(56) References Cited

U.S. PATENT DOCUMENTS

| | | | | |
|---|---|---|---|---|
| 5,090,482 | A * | 2/1992 | Baron et al. | 169/46 |
| 5,353,879 | A | 10/1994 | Watanabe et al. | |
| 6,131,667 | A * | 10/2000 | Jesadanont et al. | 169/89 |
| 6,510,901 | B2 * | 1/2003 | Yen et al. | 169/47 |

FOREIGN PATENT DOCUMENTS

| | | |
|---|---|---|
| JP | 58-174258 | 10/1983 |
| JP | 64-6822 | 2/1989 |
| JP | 03-186276 | 8/1991 |
| JP | 03-186277 | 8/1991 |
| JP | 2000-093536 | 4/2000 |
| JP | 2005-287655 | 10/2005 |

* cited by examiner

*Primary Examiner* — Davis Hwu
(74) *Attorney, Agent, or Firm* — Wenderoth, Lind & Ponack, L.L.P.

(57) ABSTRACT

A tube-end device for fire extinguishment jets and sprays pressurized and fed water, seawater, or aqueous fire-extinguishing agent from a tube end. The tube-end device for fire extinguishment is provided with: an induction electrode unit disposed in an emission space side of a nozzle unit positioned inside the tube end; a water-side electrode unit disposed at a position of the interior of a tube main body in contact with fire-extinguishing water; a voltage applying device which applies an external electric field, which is generated by applying a voltage between the induction electrode unit and the water-side electrode unit, to the water, seawater, or fire-extinguishing agent in the process of jetting from the nozzle unit, electrically charges jetted particles, and emit the particles; and a battery which supplies power to the voltage applying device.

10 Claims, 8 Drawing Sheets

TUBE-END DEVICE FOR FIRE EXTINGUISHMENT

This application is a continuation of PCT/JP2009/050655 filed Jan. 19, 2009.

The PCT application of PCT/JP2009/050655 is a priority based on prior application No. JP2008-047483, filed Feb. 28, 2008, in Japan.

BACKGROUND OF THE INVENTION

1. Field of the Invention

The present invention relates to a tube-end device for fire extinguishment which sprays fire-extinguishing water, which is pressurized and fed via a hose or the like, toward fire.

2. Description of the Related Arts

Conventionally, tube-end devices for fire extinguishment of this type include tube-end devices called a rod-like water discharge type having a circular nozzle cross section and a so-called spray nozzle which emits fine water particles since it has a nozzle cross section of ring-like slits. The spray nozzle is provided with a jetting-angle adjusting mechanism. The operator thereof carries out operations depending on the state of fire, for example, when the point of fire cannot be easily recognized due to smoke or the like, the operator carries out water-sprinkle cooling of the vicinity of the point of fire by carrying out wide-angle emission by which fine water particles can be jetted at a wide angle; and, when the point of fire can be recognized, the operator carries out concentrated emission toward the point of fire by narrow-angle jetting. Moreover, a tube-end device of a so-called two-fluid type which jets pressurized and fed fire-extinguishing water in the form of mist while introducing compressed air or the like at the same time is also known. The tube-end device of the two-fluid type can emit the fire-extinguishing water particles in the form of finer mist at high speed; therefore, higher extinguishing efficiency, the effect of cooling the atmosphere, and, in the case of wide-angle spraying, suppressing of a smoke-containing gas are enabled.

Patent Document 1: Japanese Patent Application Laid-Open (kokai) No. 2000-093536

Patent Document 2: Japanese Patent Publication (kokoku) No. 64-006822

However, in the fire-extinguishing methods using such conventional tube-end devices using fire-extinguishing water, for example, particularly in fire or the like in a sectionally-owned condominium, water damage caused by the fire-extinguishing water reaches several lower floors other than the fire room, and reduction of the water damage has been a problem. Moreover, regarding the matters burnt in fire, due to increase of synthetic resins, the quantity of smoke is increasing, and obstruction thereof in terms of fire-extinguishing operation is a problem. Therefore, a tube-end device having a higher smoke controlling ability and capable of efficiently extinguishing fire with a fire-extinguishing water quantity further smaller than that of the spray nozzle and, as a matter of course, that of the conventional rod-like water discharging nozzle is desired.

SUMMARY OF THE INVENTION

According to the present invention, a tube-end device for fire extinguishment capable of efficiently extinguishing fire with a small quantity of fire-extinguishing water and having a higher smoke controlling ability is provided.

The present invention is a tube-end device for fire extinguishment which jets and sprays pressurized and fed water, seawater, or aqueous fire-extinguishing agent from a tube end, characterized by having:

an induction electrode unit disposed in an emission space side of a nozzle unit positioned inside the tube end;

a water-side electrode unit disposed at a position of the interior of a tube main body in contact with fire-extinguishing water;

a voltage applying unit applying an external electric field, which is generated by applying a voltage between the induction electrode unit and the water-side electrode unit, to the water, seawater, or fire-extinguishing agent in the process of jetting from the nozzle unit, electrically charging jetted particles, and emitting the particles; and a power supply unit supplying power to the voltage applying unit.

Herein, the water-side electrode unit is part of the interior of the tube main body using an electrically-conductive material and being in contact with the fire-extinguishing water.

The voltage applying unit has a voltage application switch applying a voltage between the induction electrode unit and the water-side electrode unit.

In the tube-end device for fire extinguishment of the present invention, a pressurized gas jetting opening jetting a pressurized gas so as to jet the pressurized gas together with the water, seawater, or aqueous fire-extinguishing agent from the nozzle unit is furthermore provided in the tube main body.

The pressurized gas jetting opening jets air or an inert gas as the pressurized gas.

The induction electrode unit is any of or a composite of a metal having electrical conductivity, a resin having electrical conductivity, and a rubber having electrical conductivity.

The voltage applying unit applies a voltage not exceeding ±20 kilovolts to the induction electrode unit when the voltage of the water-side electrode unit is caused to be zero volt.

The voltage applying unit applies a DC, AC, or pulse-like voltage to the induction electrode unit when the voltage of the water-side electrode unit is caused to be zero volt.

Part or all of the induction electrode unit is coated with an insulating material.

The nozzle unit is provided with a jetting-angle adjusting mechanism.

(Fire-Extinguishing Effect)

According to a tube-end device for fire extinguishment of the present invention, when the fire-extinguishing water particles from a conventional spray nozzle or the tube-end device of the two-fluid type are further electrically charged, adhesion to all the surfaces of burning materials, not to mention the adhesion to burning surfaces is caused by the Coulomb force, and a high wetting effect with respect to burning surfaces and unburnt surfaces can be obtained compared with conventional water particles which are not electrically charged. Moreover, for example when the particles are electrically charged only with negative electric charge and emitted, repulsive force works between the water particles in space, the possibility that the particles grow and fall due to collision and association is lowered, and the density of water particles staying in the air and the specific surface area thereof are kept large. As a result, a high cooling effect of the space and an effect of reduction of relative oxygen concentration caused by evaporated vapor can be obtained. By virtue of synergy of these effects, the fire-extinguishing performance is significantly improved by the electrically-charged emission of the tube-end device for fire extinguishment of the present invention, compared with conventional emission without electrical charge.

(Smoke Removing Effect)

According to the tube-end device for fire extinguishment of the present invention, a high smoke controlling effect is obtained. The conventional smoke capturing by emission without electrical charge is a capturing action by probabilistic collision of smoke particles and fire-extinguishing water particles. On the other hand, in the present invention, the smoke particles in an electrically-charged state are captured by the Coulomb force by electrically charging the fire-extinguishing water particles; therefore, the capturing effect is increased, and a high smoke controlling effect is obtained.

DETAILED DESCRIPTION OF THE PREFERRED EMBODIMENT

Figure 1:
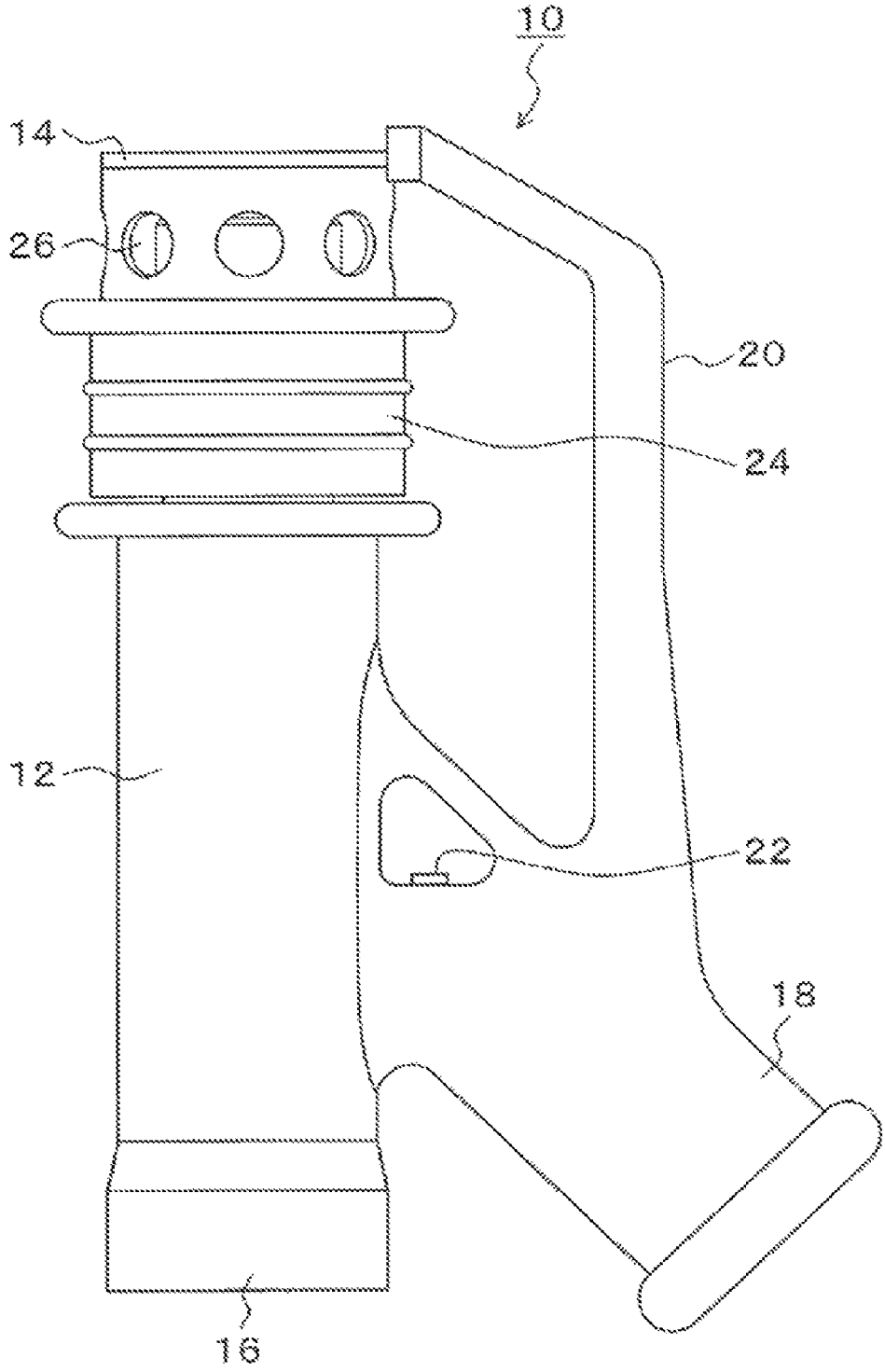
FIG. 1 is an explanatory drawing showing an embodiment of a tube-end device for fire extinguishment according to the present invention.

FIG. 1 is an explanatory drawing showing an embodiment of a tube-end device for fire extinguishment according to the present invention. In FIG. 1, in the tube-end device for fire extinguishment 10 of the present embodiment, a tube end 14 having a nozzle unit is provided at the distal end side of a main body 12 thereof, a water-hose connecting opening 16 is provided at the root side thereof, a water hose is connected to the water-hose connecting opening 16 via a valve or the like, and water, seawater, or an aqueous fire-extinguishing agent is pressurized and fed thereto and sprayed from the tube end 14. A frame 20 having a gripping unit 18 is provided integrally with the main body 12, and a voltage application switch 22 for electrically charging and emitting jetted particles is provided in the gripping unit 18-side of the frame 20. An emission-angle adjusting handle 24 is provided in the tube end 14-side of the main body 12. When the emission-angle adjusting handle 24 is rotated, the emission angle of the sprayed fire-extinguishing water jetted from the tube end 14 can be adjusted. Moreover, air-intake holes 26 are provided in the tube end 14-side, thereby enabling intake of air along with jetting of the fire-extinguishing water from a nozzle disposed inside the tube end 14.

Figure 2:
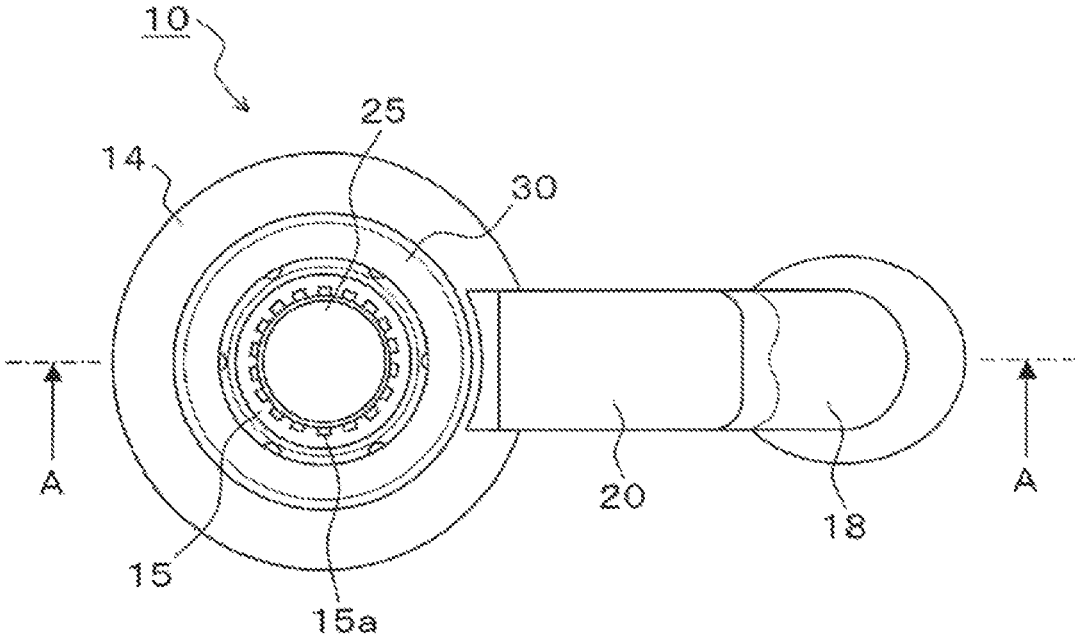
FIG. 2 is an explanatory drawing showing the embodiment of FIG. 1 from the tube end side.

FIG. 2 is an explanatory drawing showing the embodiment of FIG. 1 from the tube end side. In FIG. 2, a cylindrical opening is provided in the tube end 14, which is serving as the distal end of the main body 12, a deflector 25 is disposed in the center side in the cylindrical opening, and the nozzle unit 15 having ring-like slits 15*a* on the inner periphery thereof is disposed at the outside of the deflector. Moreover, an induction electrode unit 30, which is one of the electrodes for electrically charging the jetted particles by applying an external electric field to the particles as shown by dotted lines, is disposed at a distal end side position which is outside of the nozzle unit 15 serving as the interior of the main body 12.

Figure 3:
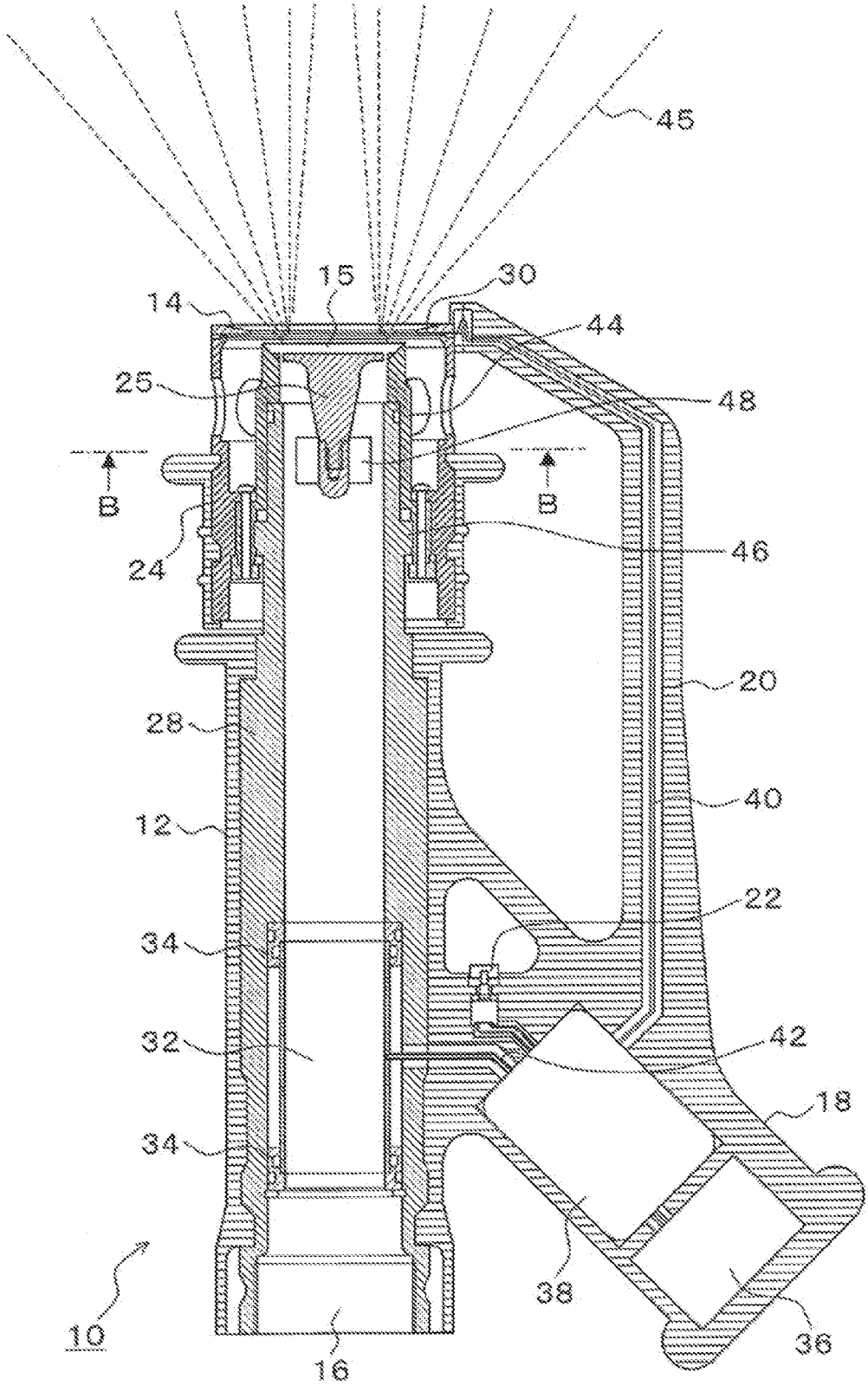
FIG. 3 is a cross sectional drawing showing the internal structure of the present embodiment as the A-A cross section of FIG. 2.
Figure 4A:
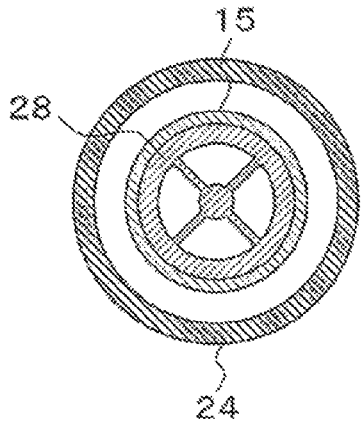
FIGS. 4A and 4B are cross sectional end views showing an emission-angle adjusting mechanism of the present embodiment as the B-B cross section of FIG. 3.
Figure 4B:
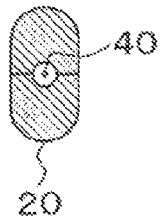
Figure 5:
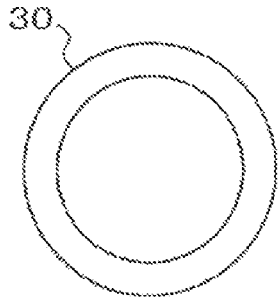
FIG. 5 is an explanatory drawing extracting and showing an induction electrode unit used in the present embodiment.

FIG. 3 is a cross sectional drawing showing the internal structure of the present embodiment as the A-A cross section of FIG. 2. In FIG. 3, the tube-end device for fire extinguishment 10 of the present embodiment houses a tube main body 28, which has a cylindrical hole penetrating in the axial direction, in the main body 12. The main body 12 is formed integrally with the frame 20 having the gripping unit 18 and is made of an insulating material such as a synthetic resin. The water-hose connecting opening 16 is provided at a lower part of the tube main body 28, which is disposed in the main body 12 and composed of an electrically conductive metal. The nozzle unit 15 is formed in the tube end 14-side, which is an upper part of the tube main body 28, and the deflector 25 is disposed in the nozzle unit 15. The deflector 25 is supported in the tube main body 28 by a deflector supporting bridge unit 48. The nozzle unit 15 is formed integrally with the distal end of an emission-angle adjusting tube 44, which is disposed at the distal end of the tube main body 28. The emission-angle adjusting tube 44 is attached to the tube main body 28 by screwing by an emission-angle adjusting screw unit 46 so as to be movable in the axial direction. More specifically, in the emission-angle adjusting screw unit 46, an outer thread is formed on the tube main body 28-side, and an inner thread formed on the emission-angle adjusting tube 44-side is screwed therewith. The emission-angle adjusting handle 24 composed of an insulating material is fixed to the outside of the emission-angle adjusting tube 44. When the emission-angle adjusting handle 24 is rotated, the emission-angle adjusting tube 44 rotates integrally, and the emission-angle adjusting tube 44 is moved in the axial direction by the emission-angle adjusting screw unit 46 while the tube main body 28-side is fixed. As a result, the nozzle unit 15 moves in the axial direction relative to the deflector 25, so that the emission angle of the fire-extinguishing water 45 sprayed from the tube end 14 can be adjusted by the change in the distance from the deflector to the ring-like slits 15*a* of the nozzle unit 15 shown in FIG. 2 formed in the periphery of the deflector 25. Herein, FIG. 3 shows the state in which the emission angle of the sprayed fire-extinguishing water 45 is caused to be in the wide-angle side by moving the emission-angle adjusting tube 44 to the deflector 25-side, which is serving as the fixed side. The deflector supporting bridge unit 48 has the structure shown in a cross sectional end view of FIGS. 4A and 4B showing the B-B cross section of FIG. 3. In FIGS. 4A and 4B, the deflector supporting bridge unit 48 projects a bridge unit in a cross shape with respect to the tube main body 28 from a ring-like supporting unit to the center and supports the deflector 25 at the center. Referring again to FIG. 3, in the tube-end device for fire extinguishment of the present embodiment, the induction electrode unit 30 is disposed at an outside position that is in the opening side relative to the nozzle unit 15 provided in the tube end 14-side. The induction electrode unit 30 is an electrically conductive member having a ring-like shape as extracted to and shown in FIG. 5. Meanwhile, a water-side electrode unit 32 is disposed in the interior of the tube main body 28 which is in the water hose connecting opening 16-side. The water-side electrode unit 32 is an electrically-conductive cylindrical member using a metal, the top and the bottom thereof are supported by and fixed to the tube main body 28 by electrode supporting rings 34 using insulators, and O-rings are attached to the inside and outside of the electrode supporting ring 34, respectively, so that the fire-extinguishing water does not enter the outside of the electrode supporting rings 34. Herein, a metal having electrical conductivity is used as the induction electrode unit 30 and the water-side electrode unit 32; however, other than that, a resin having electrical conductivity, a rubber having electrical conductivity, or a composite of a metal, resin, or rubber having electrical conductivity may be used. Moreover, the induction electrode unit 30 and the water-side electrode unit 32 may have a structure which is partly or entirely coated with an insulating material. A battery 36 and a voltage applying device 38 are incorporated in the gripping unit 18 of the frame 20, which is integrally provided in the right side of the main body 12. The battery 36 supplies DC power to the voltage applying device 38. The voltage applying device 38 is connected to the induction electrode unit 30, which is provided so as to be opposed to the nozzle unit 15, by induction electrode wiring 40, and the voltage applying device 38 is also connected to the water-side electrode unit 32 by water-side electrode wiring 42. Furthermore, the voltage applying device 38 is connected to the voltage application switch 22, which is provided at a position of the gripping unit 18 to be held by a finger, by wiring. When the voltage application switch 22 is operated to be on, the voltage applying device 38 applies a predetermined voltage, for example, a voltage of several volts, which does not exceed 20 kilovolts, to the induction electrode unit 30, while the water-side voltage unit 32 is caused to be at 0 volt, applies an external electric field to the fire-extinguishing water, which is in the jetting process of jetting the water from the nozzle unit 15, electrically charges the jetted particles thereof, and causes them to be emitted as the sprayed fire-extinguishing water 45.

Figure 6:
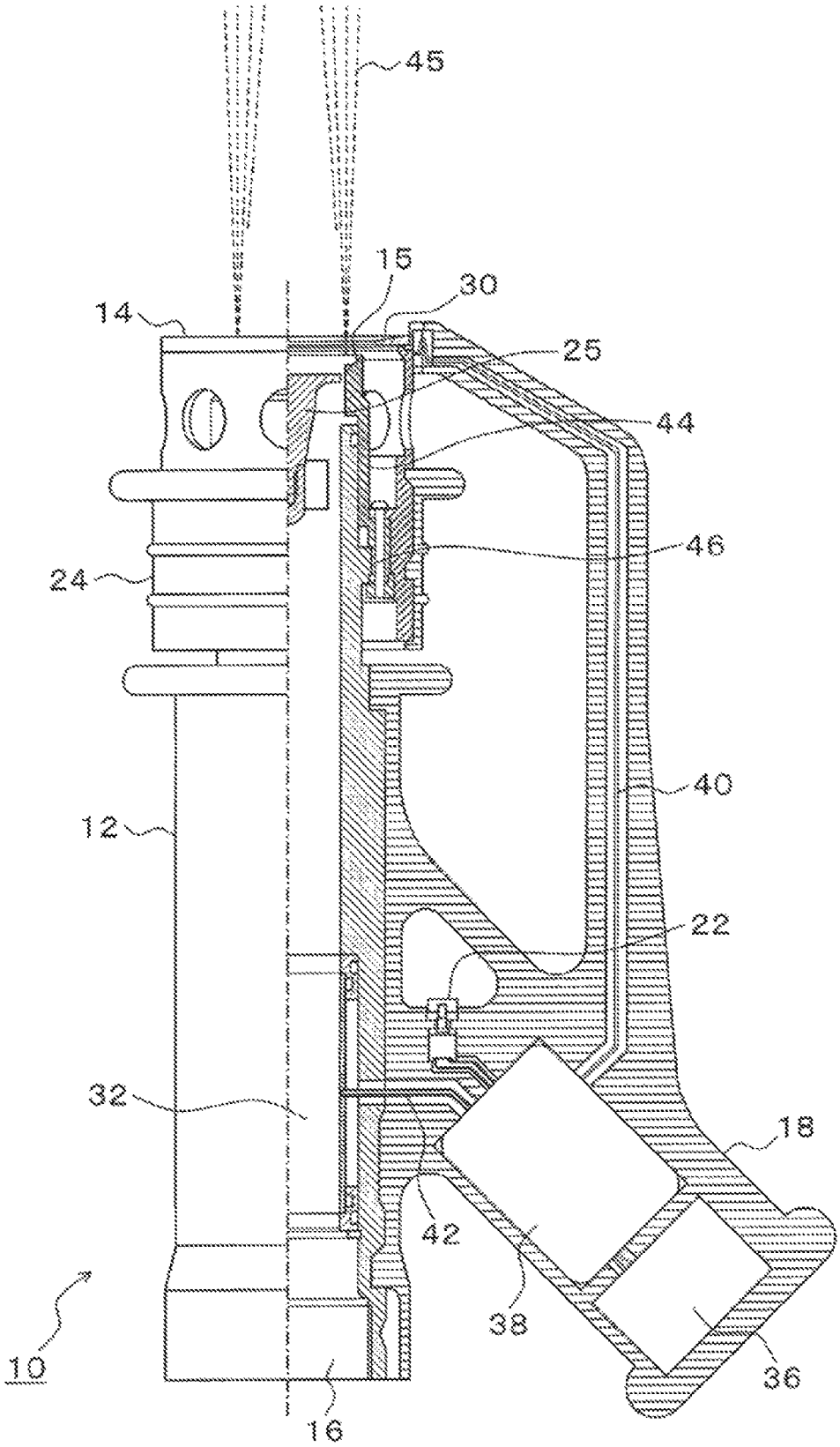
FIG. 6 is a cross sectional drawing showing the state in which an emission angle is adjusted to the narrow-angle side in the present embodiment.

FIG. 6 is a cross sectional drawing showing the state in which the emission angle is adjusted to the narrow-angle side in the present embodiment.

When the emission-angle adjusting tube 44 is advanced so that the nozzle unit 15 projects relative to the deflector 25 as shown in FIG. 6 by rotating the emission-angle adjusting handle 24 from the state of the wide-angle side of the sprayed fire-extinguishing water 45 shown in FIG. 3, the emission angle of the sprayed fire-extinguishing water 45 can be adjusted to the narrow-angle side.

In such tube-end device for fire extinguishment of the present embodiment, an operator such as a firefighter uses the tube-end device for fire extinguishment 10 of the present embodiment by attaching the device to the distal end of a water hose, operates the emission-angle adjusting handle 24 depending on the state of fire upon fire-extinguishing operations, and extinguishes fire while carrying out the wide-angle emission of the sprayed fire-extinguishing water 45 as shown in FIG. 3 or the narrow-angle emission of the sprayed fire-extinguishing water 45 as shown in FIG. 6. When the voltage application switch 22 provided at the part of the gripping unit 18 to be held by a finger is operated to be on at this point, a voltage of, for example, several kilovolts is applied from the voltage applying device 38 to the induction electrode unit 30 and the water-side electrode unit 32. An external electric field is generated between both the electrodes by this voltage application, jetted particles are electrically charged through the jetting process of converting the fire extinguishing water to the jetted particles from the nozzle unit 15, and the electrically charged jetted particles can be sprayed to the outside. Next, the fire-extinguishing effects according to the present embodiment will be explained. In the electrically-charged spraying according to the present embodiment, when the water particles are electrically charged, adhesion to all the surfaces of burning materials, not to mention the adhesion to highly burning surfaces is caused by the Coulomb force, and the wetting effect is significantly increased compared with conventional water particles which are not electrically charged. Therefore, high fire-extinguishing power is obtained. Furthermore, for example when the particles are electrically charged only with negative electrical charge and emitted, repulsive force works between the water particles in space, the possibility that the particles grow and fall due to collision and association is lowered, and the density of water particles staying in the air is increased, which also serves as a factor of the high fire extinguishing ability. Because of these reasons, in the electrically-charged emission of the water particles according to the present embodiment, the fire-extinguishing performance is significantly improved compared with the conventional spraying without electrical charge.

The reason why a high smoke removing effect can be obtained by the electrically-charged spraying of the present embodiment is that, in the present embodiment, the smoke removing effect is increased since the smoke particles in an electrically-charged state are captured by the Coulomb force by electrically charging the water particles, while the conventional capturing of smoke by spraying without electrical charge is a capturing means by probabilistic collision of smoke particles and water particles. For example, if there are water particles of 100 to 200 μm which are in the electrically-charged state, the smoke particles which are similarly in the electrically-charged state are 1 to 2 μm, and the water particles capture many small smoke particles present in the peripheries by the Coulomb force. As a result, a large smoke removing effect can be obtained. Below experiments were carried out for confirming increase in the smoke removing effect according to the present embodiment.

Experiment Example

Figure 7:
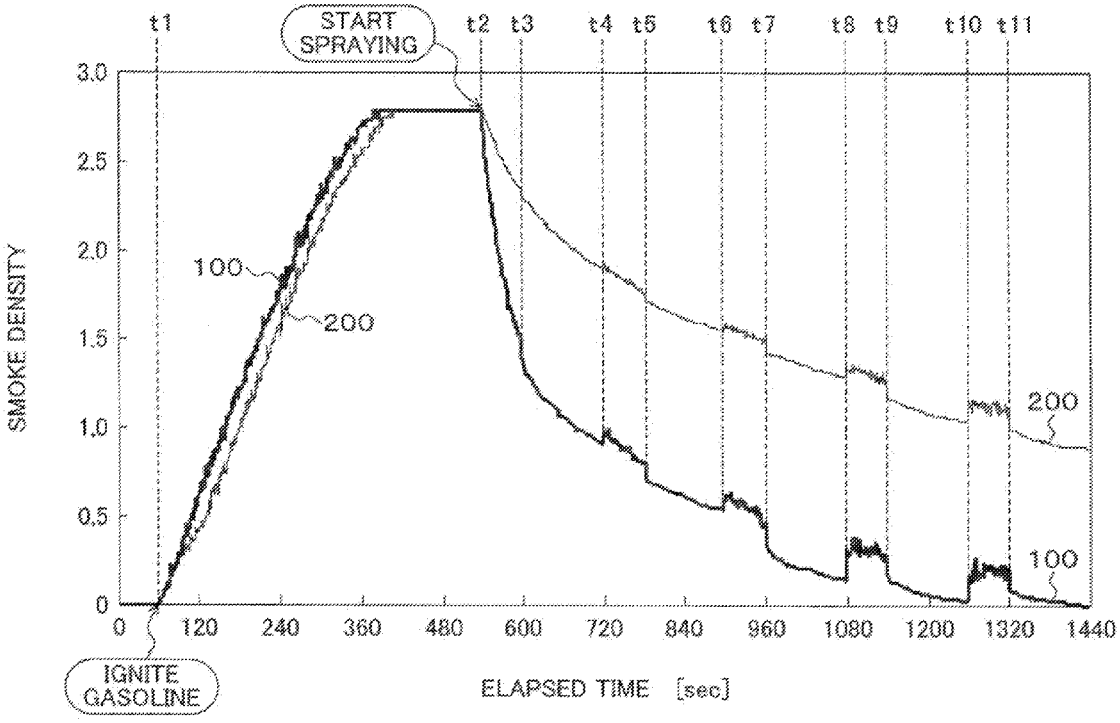
FIG. 7 is a graph chart showing experiment results for confirming the smoke removing effect according to the present embodiment.

Nozzle jetting quantity: 8 liters/minute at 1 MPa
Induction electrode voltage: 2 kilovolts
Water discharge pattern: water discharge with pulse-like application
Fire model: After burning 50 milliliters of gasoline in a closed space of 1.8 cubic meters and filling the space with smoke, 5 cycles of spraying each of which comprising 60-second water discharge and 120-second interval are carried out, and the transition of smoke concentration is measured FIG. 7 is a graph chart showing experiment results according to experiment examples. The experiment results of FIG. 7 show the elapsed time by the horizontal axis and the smoke concentration by the vertical axis. An experiment characteristic 100 is the electrically-charged spray according to the present embodiment, and an experiment characteristic 200 is conventional spray without electrical charge.

In FIG. 7, after the gasoline is ignited at time t1, the smoke concentration is rapidly increased as shown by the experiment characteristics 100 and 200. When it is actually observed from outside, the interior of the closed space is solid black due to the smoke caused by burning and is in a completely invisible state. Subsequently, spraying is started at time t2. In the experiment characteristic 100 of the present embodiment, first, the electrically-charged spraying of a first time is carried out from time t2 to t3. The smoke concentration is rapidly lowered to 1.3 percent by this electrically-charged spraying of the first time. When it is visually observed, the change in the smoke concentration from the time t2 to t3 is a rapid smoke removing action in which the smoke quickly disappears, and the state of the smoke in the closed space which has been solid black becomes the state in which the interior can be slightly seen. This is carried out within the electrically-charged spraying of only 60 seconds. Subsequently, after the interval of 120 seconds is finished, the electrically-charged spraying of a second time is carried out at time t4 to t5. Thereafter, when the electrically-charged spraying is repeated at t6 to t7, t8 to t9, and t10 to t11, along with the increase in the number of times of electrically-charged spraying, the smoke concentration becomes approximately 0 percent, for example, in the electrically-charged spray of the fifth time, in other words, the smoke can be removed to the state in which there is completely no smoke.

On the other hand, in the conventional characteristic 200 which is the spraying without electrical charge, as well as the experiment characteristic of the present embodiment, spraying without electrical charge is carried out five times at the time t2 to t3, time t4 to t5, time t6 to t7, time t8 to t9, and time t10 to t11 with 120-second intervals therebetween. However, reduction of the smoke concentration is moderate, the smoke concentration in the conventional experiment characteristic 200 without electrical charge is approximately two times that of the experiment characteristic 100 of the present embodiment. According to this comparison of the experiment characteristics, it has been confirmed that a significant smoke removing effect can be obtained in the present embodiment.

FIGS. 8A to 8F are time charts showing the application voltage applied between the induction electrode unit 30 and the water-side electrode unit 32 from the voltage applying device 38 of the present embodiment.

Figures 8A, 8B, 8C, 8D, 8E, 8F:
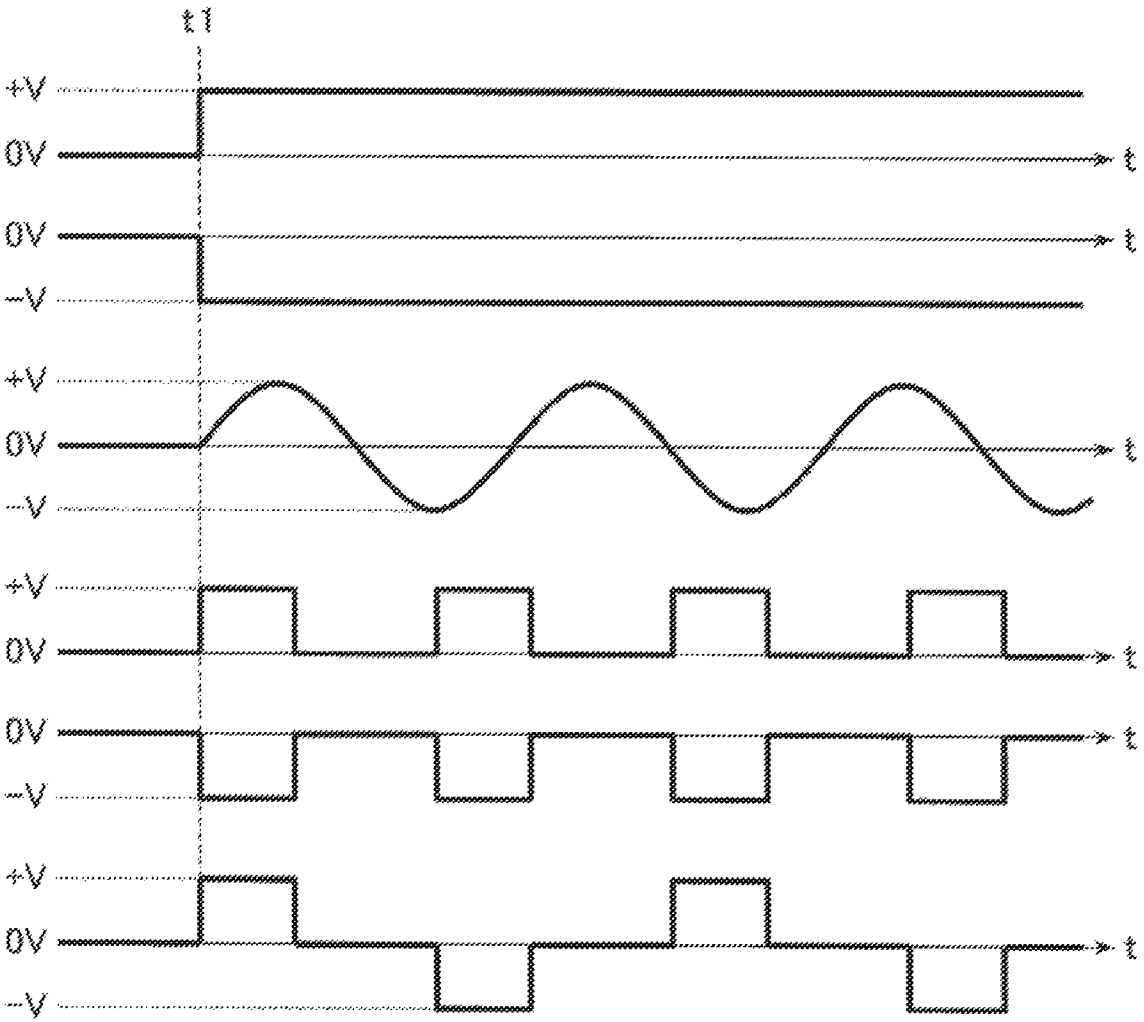
FIGS. 8A to 8F are time chart diagrams showing the application voltage supplied to an electrically-charged spray head of the present embodiment.

FIG. 8A shows the case in which a DC voltage of +V is applied, and negatively electrically charged water particles are continuously sprayed in this case.

FIG. 8B shows the case in which a DC voltage of −V is applied, and positively electrically charged water particles are continuously sprayed in this case.

FIG. 8C shows the case in which an AC voltage of ±V is applied. In this case, negatively electrically charged water particles are continuously sprayed in accordance with change in the AC voltage during the periods of positive half cycles, and positively electrically charged water particles are alternately sprayed in accordance with change in the AC voltage during the periods of negative half cycles.

FIG. 8D shows the case in which a pulse-like voltage of +V is applied with predetermined intervals. In this case, negatively electrically charged water particles are intermittently sprayed, and water particles which are not electrically charged are sprayed during the periods in which the voltage is not applied.

FIG. 8E shows the case in which a pulse-like voltage of −V is applied with predetermined intervals. In this case, positively electrically charged water particles are intermittently sprayed, and water particles which are not electrically charged are sprayed during the periods in which the voltage is not applied.

FIG. 8F shows the case in which a pulse-like voltage of ±V is alternately applied with predetermined intervals. In this case, negatively electrically charged water particles and positively electrically charged water particles are alternately sprayed with intervals, and water particles which are not electrically charged are sprayed during the periods in which the voltage is not applied. A commercially-available step-up unit equipped with control input can be utilized as the voltage applying device 38, which applies the application voltages shown in FIGS. 8A to 8F between the induction electrode unit 30 and the water-side electrode unit 32.

Commercially-available step-up units include a unit which outputs DC to 20 kilovolts when DC 0 to 20 volts are applied to the input, and such a commercially-available unit can be utilized.

Figure 9:
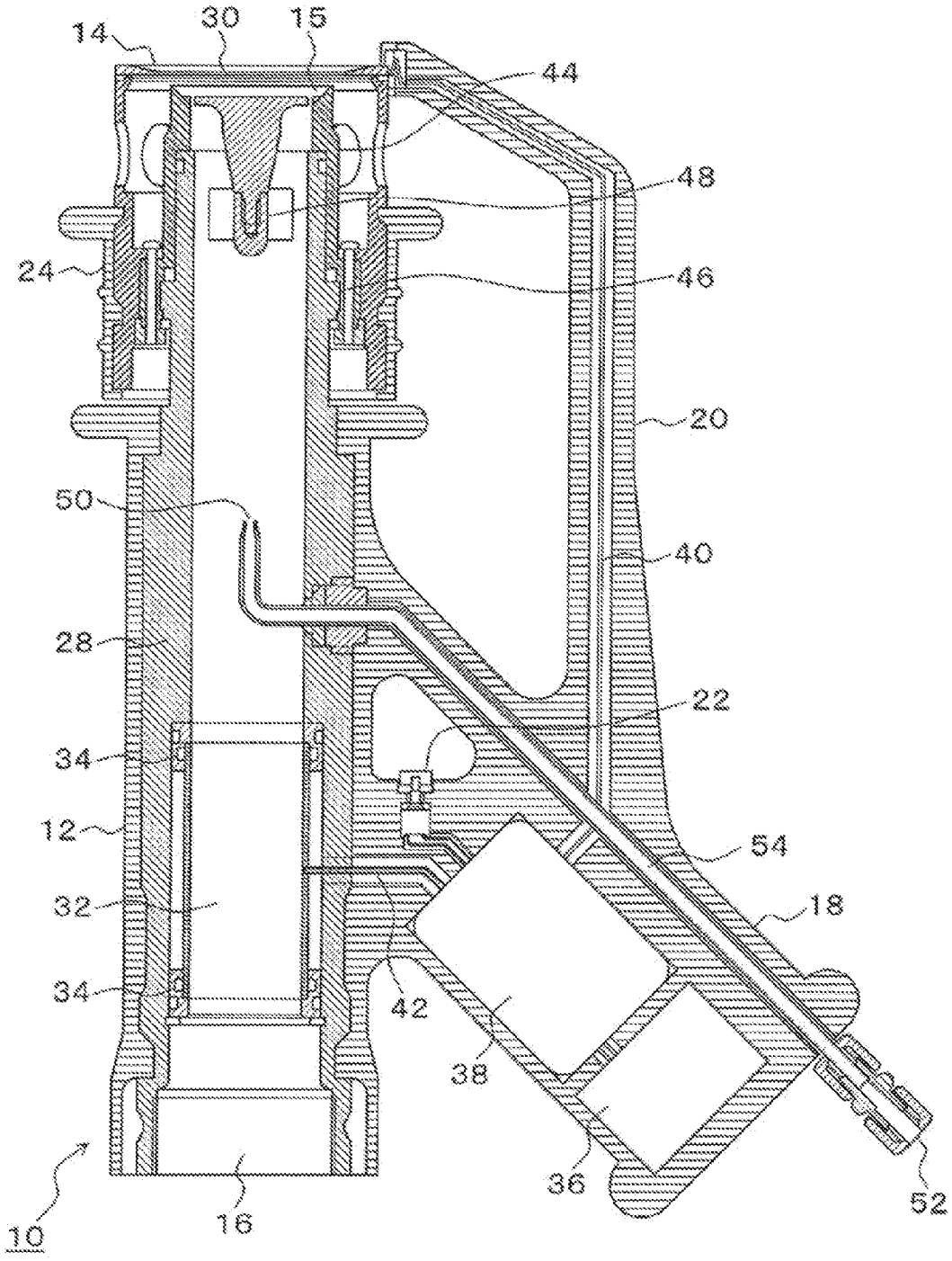
FIG. 9 is an explanatory drawing showing another embodiment of the tube-end device for fire extinguishment according to the present invention wherein the two-fluid method is employed by providing a pressurized gas jetting opening.

FIG. 9 is an explanatory drawing showing another embodiment of the tube-end device for fire extinguishment according to the present invention wherein the two-fluid method is employed by providing a pressurized gas jetting opening. In FIG. 9, the tube-end device for fire extinguishment 10 has the same structure as FIG. 3; however, in addition to that, the pressurized gas jetting opening 50 is disposed toward the jetting direction at an intermediate part of the fire-extinguishing water supply path in the tube main body 28. The pressurized gas jetting opening 50 is disposed by bending and forming the distal end of a pressurized gas supply tube 54, which is provided in the gripping unit 18 of the frame 20, a pressurized gas supply connection opening 52 is provided in the root side of the pressurized gas supply tube 54, and a pressurized gas is supplied thereto by a rubber hose or the like having reinforced coating. As the pressurized gas supplied to the pressurized gas supply connection opening 52, compressed air or an inert gas such as carbon dioxide or nitrogen is supplied.

In the embodiment of FIGS. 8A to 8F, at the same time as the supply of the fire-extinguishing water from the water-hose connecting opening 16, the pressurized gas such as the air or the inert gas is supplied from the pressurized gas supply connection opening 52 and jetted from the pressurized gas jetting opening 50 so that they are jetted from the nozzle unit 15 at the same time. As a result, finer fire-extinguishing water particles in the form of mist can be emitted at high speed. When the voltage application switch 22 is operated to be on at the same time in addition to the emission by the two-fluid method, a voltage of, for example, several kilovolts is applied between the induction electrode unit 30 and the water-side electrode unit 32, an electric field is generated between both the electrodes, the jetted particles jetted from the nozzle unit 15 are electrically charged, and the electrically-charged jetted particles can be sprayed to the outside. When such miniaturization of the jetted particles by the two-fluid method is carried out and the miniaturized secondary particles are electrically charged, higher fire-extinguishing efficiency and smoke discharge control can be realized. In the above described embodiments, the tube-end device for fire extinguishment having the emission-angle adjusting mechanism is taken as an example; however, the electrode structure which realizes the electrically-charged spraying can be similarly provided for a tube-end device for fire extinguishment having the structure in which the emission angle is fixed. Moreover, in the above described embodiments, the battery is incorporated in the tube-end device so that it can be easily carried; however, power may be supplied from outside by cable connection. For example, the operator carries a battery so that power can be supplied to the tube-end device for fire extinguishment from the portable battery. As a result, a sufficient amount of used power volume is ensured, and stable electrically-charged spraying can be carried out for a long period of time. The structure of the tube-end device for fire extinguishment of the present invention is not limited to the above described embodiments. The present invention can be applied to an arbitrary structure without change as long as the structure has the induction electrode unit and the water-side electrode unit and enables electrically-charged spraying by application of a predetermined voltage. The present invention includes arbitrary modifications which do not impair the object and advantages thereof, and the present invention is not limited by the numerical values shown in the above described embodiments.

What is claimed is:

1. A tube-end device for fire extinguishment which jets and sprays pressurized and fed water, seawater, or aqueous fire-extinguishing agent from a tube end comprising:

an induction electrode unit disposed in an emission space side of a nozzle unit positioned inside the tube end;

a water-side electrode unit disposed at a position of the interior of a tube main body in contact with fire-extinguishing water;

a voltage applying unit applying an external electric field, which is generated by applying a voltage between the induction electrode unit and the water-side electrode unit, to the water, seawater, or fire-extinguishing agent in the process of jetting from the nozzle unit, electrically charging jetted particles, and emitting the particles; and a power supply unit supplying power to the voltage applying unit.

2. The tube-end device for fire extinguishment according to claim 1, wherein the water-side electrode unit is part of the interior of the tube main body using an electrically-conductive material and being in contact with the fire-extinguishing water.

3. The tube-end device for fire extinguishment according to claim 1, wherein the voltage applying unit has a voltage application switch applying a voltage between the induction electrode unit and the water-side electrode unit.

4. The tube-end device for fire extinguishment according to claim 1, wherein a pressurized gas jetting opening jetting a pressurized gas so as to jet the pressurized gas together with the water, seawater, or aqueous fire-extinguishing agent from the nozzle unit is provided in the tube main body.

5. The tube-end device for fire extinguishment according to claim 4, wherein the pressurized gas jetting opening jets air or an inert gas as the pressurized gas.

6. The tube-end device for fire extinguishment according to claim 1, wherein the induct ion electrode unit is any of or a composite of a metal having electrical conductivity, a resin having electrical conductivity, and a rubber having electrical conductivity.

7. The tube-end device for fire extinguishment according to claim 1, wherein the voltage applying unit applies a voltage not exceeding ±20 kilovolts to the induction electrode unit when the voltage of the water-side electrode unit is caused to be zero volt.

8. The tube-end device for fire extinguishment according to claim 1, wherein the voltage applying unit applies a DC, AC, or pulse-like voltage to the induction electrode unit when the voltage of the water-side electrode unit is caused to be zero volt.

9. The tube-end device for fire extinguishment according to claim 1, wherein part or all of the induction electrode unit is coated with an insulating material.

10. The tube-end device for fire extinguishment according to claim 1, wherein the nozzle unit is provided with a jetting-angle adjusting mechanism.

* * * * *